US008723685B2

(12) United States Patent
Moon et al.

(10) Patent No.: US 8,723,685 B2
(45) Date of Patent: May 13, 2014

(54) METHOD AND APPARATUS FOR PROVIDING PUBLIC TRANSPORTATION SERVICE IN A COMMUNICATION SYSTEM

(75) Inventors: Sung-Soo Moon, Gyeonggi-do (KR); Kyung-Jin Oh, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 200 days.

(21) Appl. No.: 13/334,218

(22) Filed: Dec. 22, 2011

(65) Prior Publication Data

US 2012/0249340 A1 Oct. 4, 2012

(30) Foreign Application Priority Data

Mar. 29, 2011 (KR) ..... 10-2011-0027989

(51) Int. Cl.
*G08G 1/00* (2006.01)

(52) U.S. Cl.
USPC ..... 340/901; 340/994

(58) Field of Classification Search
USPC ..... 340/901, 989, 904, 991, 994; 701/533, 701/538, 540, 541; 455/456.1
See application file for complete search history.

(56) References Cited

U.S. PATENT DOCUMENTS

| | | | | |
|---|---|---|---|---|
| 7,880,645 | B2 * | 2/2011 | Park | 340/994 |
| 8,340,904 | B2 * | 12/2012 | Lin | 701/465 |
| 2005/0004757 | A1 * | 1/2005 | Neeman et al. | 701/210 |
| 2009/0128362 | A1 * | 5/2009 | Darwish et al. | 340/901 |

FOREIGN PATENT DOCUMENTS

KR 10-2010-0066328 A 6/2010

* cited by examiner

*Primary Examiner* — Toan N Pham
(74) *Attorney, Agent, or Firm* — Cha & Reiter, LLC

(57) ABSTRACT

A method and apparatus for providing a public transportation service in a communication system includes transmitting a signal representing an existence of a passenger at a particular stop terminal, and transmitting a signal representing information on a number of vehicles at to the stop terminal for selection by a user.

16 Claims, 8 Drawing Sheets

METHOD AND APPARATUS FOR PROVIDING PUBLIC TRANSPORTATION SERVICE IN A COMMUNICATION SYSTEM

CLAIM OF PRIORITY

This application claims priority under 35 U.S.C. §119(a) to a Korean Patent Application filed in the Korean Intellectual Property Office on Mar. 29, 2011 and assigned Serial No. 10-2011-0027989, the contents of which are herein incorporated by reference.

BACKGROUND OF THE INVENTION

1. Field of the Invention

The present invention relates to a method and apparatus for providing a public transportation service in a communication system. More particularly, the present invention relates to a method and apparatus for providing public transportation information using a local wireless communication technology.

2. Description of the Related Art

Recently, various services for improving the convenience of a public transportation are being provided. For example, a service related to providing a bus route and its expected arrival time is being provided. Thus, a mobile user can be informed of arrival time of incoming buses at different locations to find the best route during traffic congestion period. But, the current service for improving the convenience of the public transportation is limited to merely providing the bus line information and the expected arrival time information to the user. That is, in the event that a bus driver fails to recognize a passenger at a particular a bus stop, the passenger has no way of prevent this type of inconvenience.

Further, only the public transportation bus information is currently available, thus above type problem and inconvenience are still issues in taxi services.

SUMMARY OF THE INVENTION

An aspect of the present invention is to substantially solve at least the above problems and/or disadvantages and provides additional advantages, by providing a method and apparatus for providing a service of informing public transportation information using a communication system.

Another aspect of the present invention is to provide a method and apparatus for providing a service of allowing a public transportation stop to recognize a passenger and inform a corresponding vehicle terminal of the existence of the passenger via a mobile system.

A further aspect of the present invention is to provide a method and apparatus for allowing a public transportation stop terminal to recognize a user terminal using a local wireless communication technology and provide available transportation information to the user terminal.

According to one aspect of the present invention, a method of a user terminal for providing a public transportation service in a communication system is provided. The method includes transmitting a signal representing user existence to a stop terminal, and transmitting a signal representing information on a desired vehicle to the stop terminal.

According to another aspect of the present invention, a method of a stop terminal for providing a public transportation service in a communication system is provided. The method includes receiving a signal representing user existence from a user terminal, receiving information on a desired vehicle from the user terminal, and transmitting a signal of informing the existence of a passenger, to a terminal of the desired vehicle.

According to a further aspect of the present invention, a method of a vehicle terminal for providing a public transportation service in a communication system is provided. The method includes receiving a signal of informing that a passenger exists at a stop, from a stop terminal, and informing a user that the passenger exists at the stop.

According to yet another aspect of the present invention, an apparatus of a user terminal for providing a public transportation service in a communication system is provided. The apparatus includes a transceiver for transmitting and receiving a signal, and a controller for controlling to transmit a signal representing user existence to a stop terminal through the transceiver, and transmit a signal representing information on a desired vehicle.

According to still another aspect of the present invention, an apparatus of a stop terminal for providing a public transportation service in a communication system is provided. The apparatus includes a transceiver for transmitting and receiving a signal, and a controller for controlling a function for receiving a signal representing user existence from a user terminal through the transceiver, receiving information on a desired vehicle, from the user terminal, and transmitting a signal of informing the existence of a passenger, to a terminal of the desired vehicle.

According to still another aspect of the present invention, an apparatus of a vehicle terminal for providing a public transportation service in a communication system is provided. The apparatus includes a transceiver for receiving a signal of informing that a passenger exists at a stop, from a stop terminal, and a notification unit for informing a user that the passenger exists at the stop.

BRIEF DESCRIPTION OF THE DRAWINGS

The above features and advantages of the present invention will become more apparent from the following detailed description when taken in conjunction with the accompanying drawings in which.

DETAILED DESCRIPTION OF THE INVENTION

Preferred embodiments of the present invention will be described herein below with reference to the accompanying drawings. For the purposes of clarity and simplicity, well-known functions or constructions are not described in detail as they would obscure the invention in unnecessary detail. Also, terms described below, which are defined considering functions in the present invention, can be different depending on user and operator's intention or practice. Therefore, the terms should be defined on the basis of the disclosure throughout this specification.

Exemplary embodiments of the present invention provide a method and apparatus for providing a service of allowing a public transportation stop to recognize a user terminal and inform a corresponding vehicle terminal of the existence of a preliminary passenger who carries the user terminal.

Figure 1:
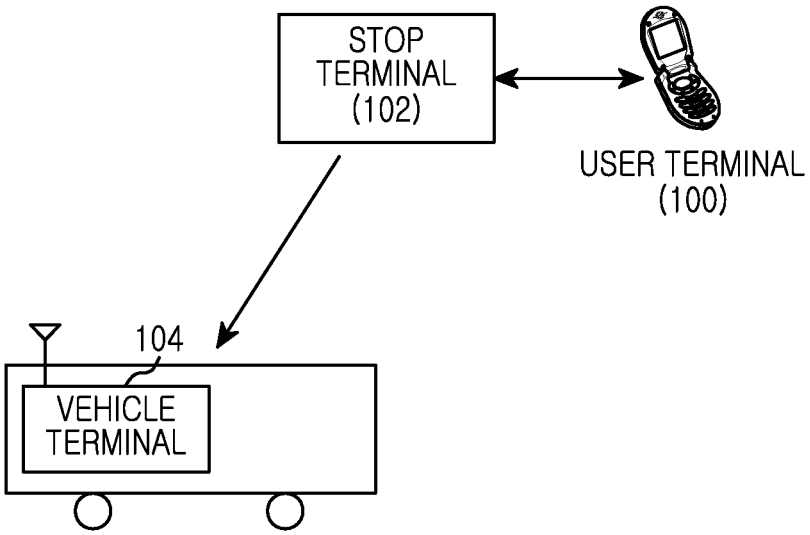
FIG. 1 is a diagram illustrating a construction of a system providing a public transportation service according to the present invention.

FIG. 1 is a diagram illustrating a construction of a system providing a public transportation service according to an embodiment of the present invention.

Referring to FIG. 1, the system providing the public transportation service includes a user terminal 100, a stop terminal 102, and a vehicle terminal 104.

The user terminal 100 supports a Near Field Communication (NFC) function and, through the NFC function, transmits and receives a signal with the stop terminal 102. To support a public transportation service according to the present invention, the user terminal 100 transmits a preset signal to the stop terminal 102. Here, the signal transmitted by the user terminal 100, which is a signal for informing that the user terminal 100 exists at a corresponding stop, can include information of the user terminal 100.

In response, the user terminal 100 receives information on available vehicles from the stop terminal 102 and displays the information on a screen of the terminal 102. By doing so, the user terminal 100 can select a specific vehicle according to a user control, and transmit information of the selected vehicle to the stop terminal 102. That is, the user terminal 100 selects a desired vehicle that a user intends to ride among the available vehicles, and transmits information on the selected vehicle to the stop terminal 102.

The stop terminal 102 may be installed at a public transportation stop and collects information, in real time, on various public transportation means including, but not limited to, a bus stop and a taxi stop. That is, the stop terminal 102 real-time collects information such as a current position of a vehicle going via a corresponding stop, an expected arrival time of the vehicle, a position of the nearest vehicle, riding or boarding availability and the like.

Further, the stop terminal 102 supports an NFC function and, through the NFC function, transmits and receives a signal with the user terminal 100. The stop terminal 102 receives a signal from the user terminal 100 and recognizes that a user or passenger who intends to take a corresponding public transportation means exists at the corresponding stop. In response, the stop terminal 102 collects information on an available vehicle means and transmits the collected information to the recognized user terminal 100. Here, the information on the available vehicle can include information on a bus in route to a corresponding stop or information on an empty taxi available around the corresponding stop. The stop terminal 102 recognizes that the user terminal 100 intends to take a corresponding vehicle, and transmits a signal of informing the existence of a passenger to the corresponding vehicle. It should be noted that other communication technologies widely known in the art other than NFC protocol may be used according to the teachings of the present invention.

The vehicle terminal 104 may include a Global Positioning System (GPS) function and periodically collects and transmits its position information. The transmitted position information of the vehicle may be just transmitted to the stop terminal 102, or may be transmitted to a specific server (not shown) managing a public transportation means which in turn transmits to the stop terminal 102. If a signal of informing a passenger at the corresponding stop is received from the stop terminal 102, the vehicle terminal 104 displays the received signal on a screen or outputs the received signal as an audio signal, thus notifying a vehicle driver.

Figure 2:
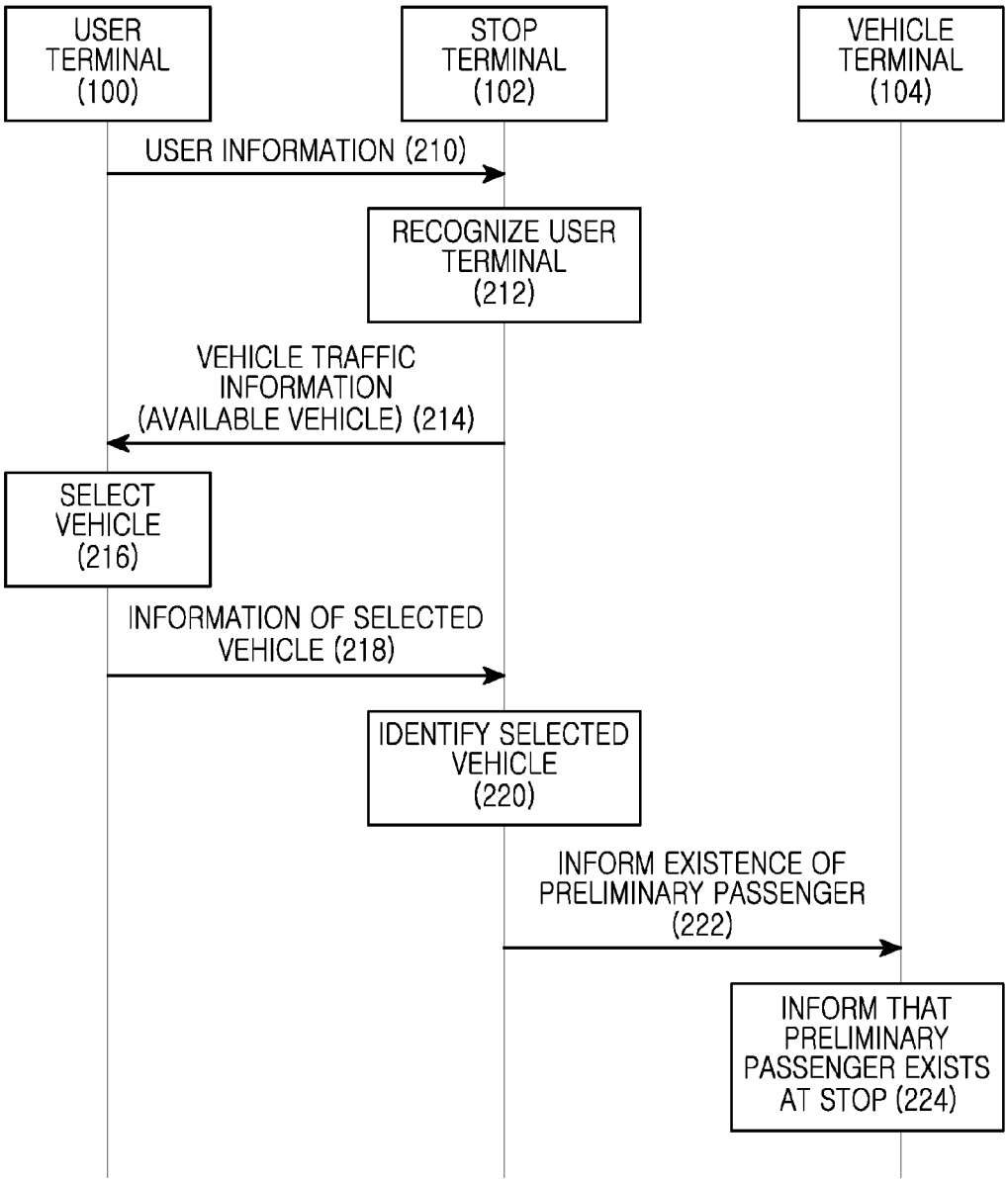
FIG. 2 is a ladder diagram illustrating a signal flow of providing a public transportation service according to an exemplary embodiment of the present invention.

FIG. 2 illustrates a signal flow of providing a public transportation service according to an exemplary embodiment of the present invention.

Referring to FIG. 2, to support a public transportation service according to the present invention, first, in step 210, a user terminal 100 transmits a preset signal to a stop terminal 102 according to a request made by a user. Here, the signal transmitted by the user terminal 100, which is a signal indicating that the mobile terminal 100 is located near a particular stop, can include a presence indication of the user terminal 100. Here, the user terminal 100 may transmit a preset signal to the stop terminal 102 in accordance with user's key manipulation, menu manipulation or specific position according to a design scheme. For example, in a case where a user executes a service inquiry function according to the present invention, the user terminal 100 may transmit a preset signal to the stop terminal 102. In an alternate embodiment, a user may register a particular stop that he/she frequently visits, so that in a case where a position of the user terminal 100 corresponds with a position of the registered stop, the user terminal 100 may automatically transmit a preset signal to the stop terminal 102.

In step 212, the stop terminal 102 receiving the signal from the user terminal 100 recognizes that a user who intends to use one of public transportation means at a corresponding stop. Then, the stop terminal 102 proceeds to step 214 and transmits information regarding an available vehicle or combination of available vehicles to the recognized user terminal 100. Here, the information on the available vehicle can include information on a particular bus line destined to the corresponding stop or information on an empty taxi positioned around the corresponding stop. For example, the information on the available vehicle can include information on a number of buses passing through the corresponding stop, a current position of the bus, and an expected arrival time, or may include information on a number of a taxi positioned around the corresponding stop, a current position of the taxi, and its availability.

In step 216, the user terminal 100 receiving the information on the available vehicle from the stop terminal 102 displays the available vehicle information on a screen, requests a user to select a desired transportation means for selection. Thereafter, in step 218, the user terminal 100 transmits information of the selected vehicle to the stop terminal 102.

If the information on the selected vehicle is received from the user terminal 100 in step 218, the stop terminal 102 proceeds to step 220 and identifies the selected vehicle. Then, in step 222, the stop terminal 102 transmits a signal to the identified vehicle terminal 104 indicative of a possible passenger.

Next, the vehicle terminal 104, upon receiving a signal indicative of the passenger at the stop, the vehicle terminal 104, in step 224, displays that the presence or existence of the passenger exists at the stop on its screen or outputs an audio or visual signal.

Figure 3:
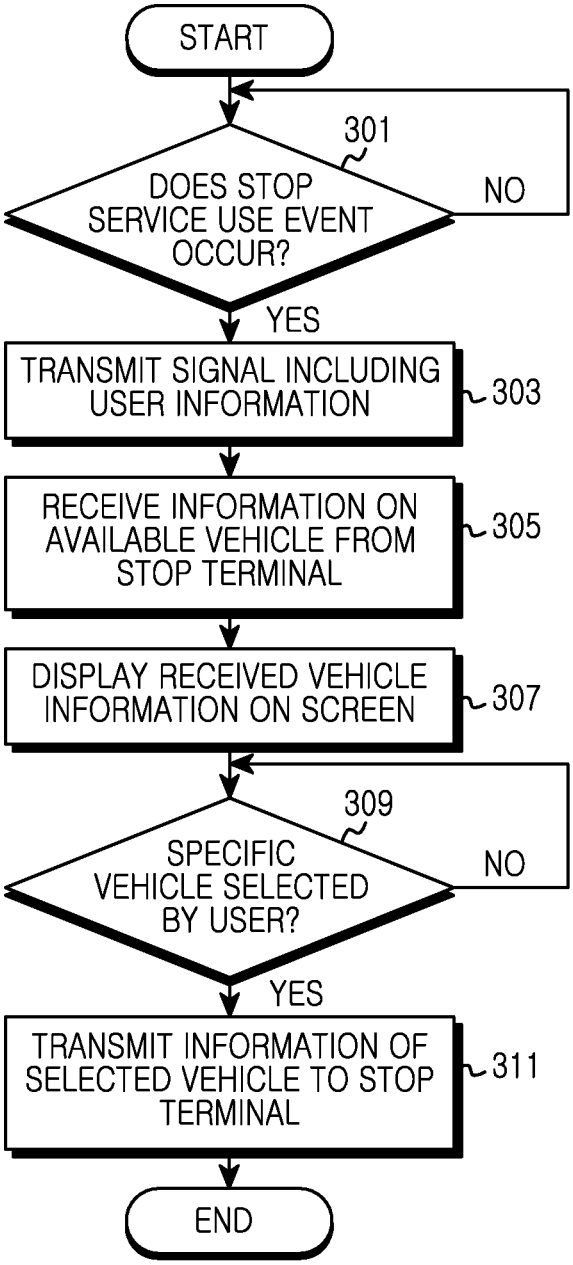
FIG. 3 is a flowchart illustrating an operation procedure of a user terminal according to an exemplary embodiment of the present invention.

FIG. 3 illustrates an operation procedure of a user terminal according to an exemplary embodiment of the present invention.

Referring to FIG. 3, in step 301, a user terminal determines if a public transportation service request event occurs at a particular transportation stop. For example, the user terminal can detect the occurrence of the public transportation service use event through user's key manipulation or menu manipulation or a position of the user terminal.

When the public transportation service use event occurs, the user terminal proceeds to step 303 and transmits a signal including the user information to a stop terminal.

In step 305, the user terminal receives information on an available vehicle(s) from the stop terminal. For example, the information on the available vehicle can include information on a number of buses passing by the corresponding stop, a current position of the bus, an expected arrival time or include information on a number of a taxi positioned around the corresponding stop, a current position of the taxi, and riding possibility or impossibility.

Next, in step 307, the user terminal displays the received vehicle information on a screen and requests a user to select a desired vehicle. The user terminal proceeds to step 309 and determines if a specific vehicle is selected by the user. When it is determined that the specific vehicle is selected by the user, in step 311, the user terminal transmits information on the selected vehicle to the stop terminal, and terminates the algorithm according to the exemplary embodiment of the present invention.

Figure 4:
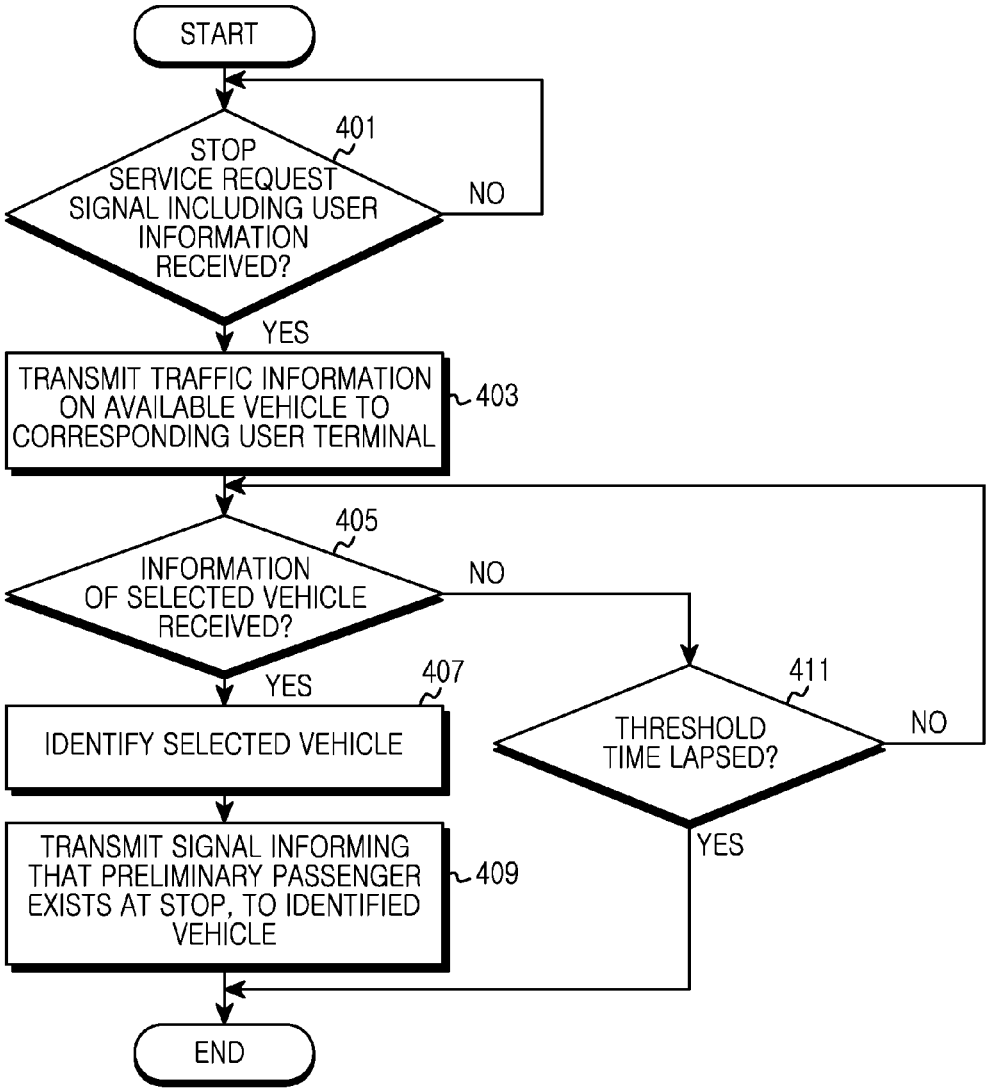
FIG. 4 is a flowchart illustrating an operation procedure of a stop terminal according to an exemplary embodiment of the present invention.

FIG. 4 illustrates an operation procedure of a stop terminal according to an exemplary embodiment of the present invention.

Referring to FIG. 4, in step 401, the stop terminal determines if a signal including user information is received from a user terminal. If it is determined in step 401 that the signal including the user information is received, the stop terminal recognizes a passenger at the corresponding stop and, in step 403, the stop terminal collects information on an available vehicle(s) and transmits the collected information on the availability to the user terminal. Here, the information on the available vehicle can include information on a bus line going via a corresponding stop or information on an empty taxi positioned around the corresponding stop. For example, the information on the available vehicle can include information on a number of a bus going via a corresponding stop, a current position of the bus, and an expected arrival time or include information on a number of a taxi positioned around the corresponding stop, a current position of the taxi, and riding possibility or impossibility.

After that, in step 405, the stop terminal determines if information on a selected vehicle is received from the user terminal. When it is determined in step 405 that the information of the selected vehicle is not received, in step 411, the stop terminal determines if a preset threshold time period has lapsed from a time when transmitting the information on the available vehicle. In a case where it is determined in step 411 that the preset threshold time period has not lapsed, the stop terminal returns to step 405 and again performs the subsequent steps. When it is determined in step 411 that the preset threshold time period has lapsed, the stop terminal terminates the algorithm according to the exemplary embodiment of the present invention.

If it is determined in step 405 that the information of the selected vehicle is received, in step 407, the stop terminal identifies the selected vehicle. And then, the stop terminal proceeds to step 409 and transmits a signal indicating a possible passenger at a corresponding stop, to a terminal of the identified vehicle. At this time, the signal indicating a possible passenger includes identification information on the corresponding stop.

Next, the stop terminal terminates the algorithm according to the exemplary embodiment of the present invention.

Figure 5:
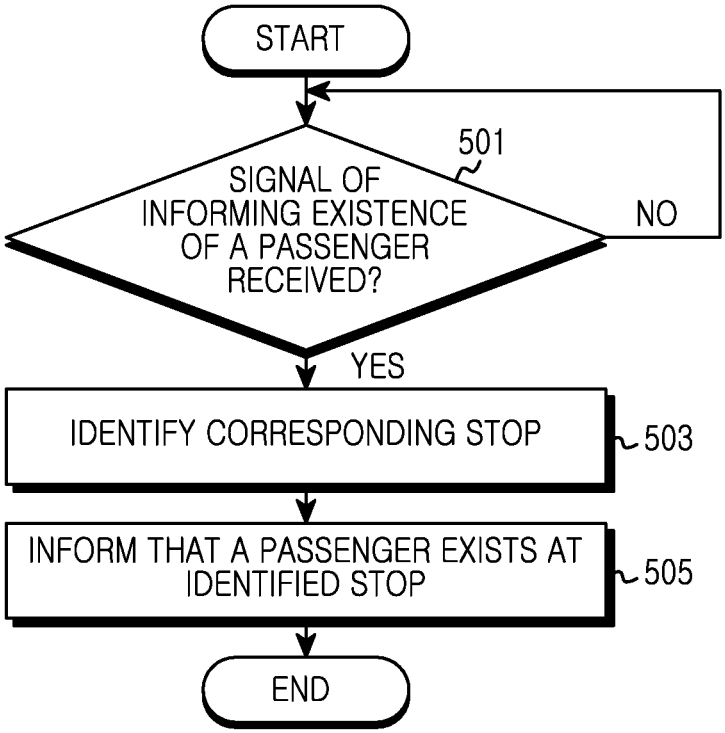
FIG. 5 is a flowchart illustrating an operation procedure of a vehicle terminal according to an exemplary embodiment of the present invention.

FIG. 5 illustrates an operation procedure of a vehicle terminal according to an exemplary embodiment of the present invention.

Referring to FIG. 5, in step 501, the vehicle terminal determines if a signal indicating a passenger is received from a stop terminal. At this time, the signal indicating a passenger includes identification information on a corresponding stop. Note that the signal informing the existence of a passenger may be received directly from the stop terminal, or may be received through a specific server managing a public transportation means.

Thereafter, in step 503, the vehicle terminal identifies a corresponding stop and, in step 505, informs that a passenger exists at the identified stop. That is, the vehicle terminal displays a message informing that a passenger exists at a corresponding stop on a screen or outputs an audio or other signal indicating the same, thus allowing a vehicle driver to prepare for a pick up. After that, the vehicle terminal terminates the algorithm according to the exemplary embodiment of the present invention.

Figure 6:
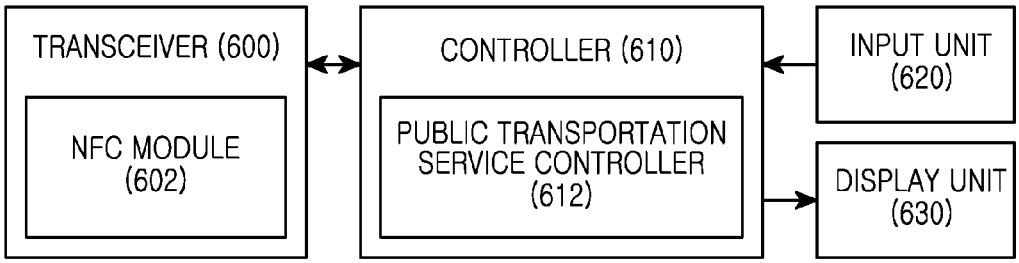
FIG. 6 is a block diagram illustrating a construction of a user terminal according to an exemplary embodiment of the present invention.

FIG. 6 is a block diagram illustrating a construction of a user terminal according to an exemplary embodiment of the present invention.

Referring to FIG. 6, the user terminal includes a transceiver 600, a controller 610, an input unit 620, and a display unit 630.

In operation, the transceiver 600 transmits and receives a signal according to the control of the controller 610. Particularly, the transceiver 600 includes an NFC module 602 and, through an NFC function, transmits and receives a signal with a stop terminal.

The controller 610 controls and processes a general operation of the user terminal. Particularly, by including a public transportation service controller 612 according to the present invention, the controller 610 controls and processes a function for transmitting a signal indicative of a user to the stop terminal, receiving information on an available vehicle from the stop terminal, selecting a vehicle that a user intends to ride, and transmitting information on the selected vehicle to the stop terminal.

The input unit 620 includes at least one of at least one key and a touch sensor, and provides data corresponding to a key pressed by a user or data of a position touched by the user, to the controller 610. The input unit 620 receives a selection of a desired vehicle by a user, and provides the same information to the controller 610.

The display unit 630 displays various state information generated during an operation of the user terminal, numerals, characters, and videos. Particularly, the display unit 630 displays, on a screen, information on an available vehicle(s) received from the stop terminal according to the control of the controller 610. At this time, the information on the available vehicle can include information on a bus line going via a corresponding stop matching with the stop terminal or information on an empty taxi positioned around the corresponding stop. For example, the information on the available vehicle can include information on a number of a bus going via a corresponding stop, a current position of the bus, and an expected arrival time, or include information on a number of a taxi positioned around the corresponding stop, a current position of the taxi, and riding possibility or impossibility.

Figure 7:
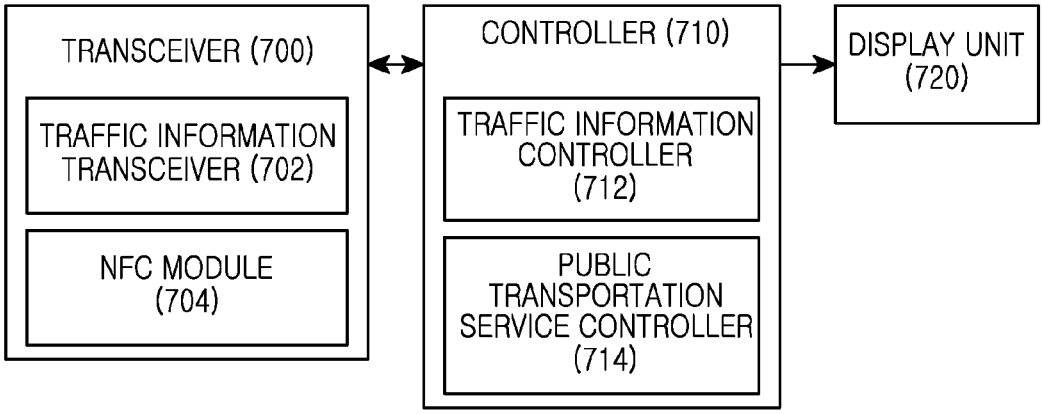
FIG. 7 is a block diagram illustrating a construction of a stop terminal according to an exemplary embodiment of the present invention.

FIG. 7 is a block diagram illustrating a construction of a stop terminal according to an exemplary embodiment of the present invention.

Referring to FIG. 7, the stop terminal includes a transceiver 700, a controller 710, and a display unit 720.

In operation, the transceiver 700 transmits and receives a signal according to the control of the controller 710. Particularly, by including a traffic information transceiver 702, the transceiver 700 collects, in real time, information on the availability of public transportation means corresponding to a particular stop. To this end, the traffic information transceiver 702 can transmit and receive a signal using various communication technologies widely known in the art. The traffic information transceiver 702 may collect information directly from a vehicle terminal or may collect information through a specific server managing the public transportation means. Further, the transceiver 700 includes an NFC module 704 and, through an NFC function, transmits and receives a signal with a stop terminal.

The controller 710 controls and processes a general operation of the stop terminal. By including a traffic information controller 712, the controller 710 controls and processes a function for real-time collection of a public transportation means at a particular stop through the traffic information transceiver 702 and provides the collected information to a user by displaying the collected information on a screen of the display unit 720. Further, by including a public transportation service controller 714, the controller 710 controls and processes a function of receiving a signal including user information from a user terminal, recognizing that a user who intends to use a corresponding public transportation means at a corresponding stop, and transmitting information on an available vehicle among the collected vehicle information to the recognized user terminal information. Further, by including the public transportation service controller 714, the controller 710 controls and processes a function of receiving information of a vehicle that a user intends to take from the user terminal, and transmitting a signal informing that a passenger exists at a corresponding stop, to a terminal of the vehicle.

The display unit 720 displays various state information generated during an operation of the stop terminal, numerals, characters, and videos. Particularly, the display unit 720 displays collected information on a public transportation means on a screen according to the control of the controller 710.

Figure 8:
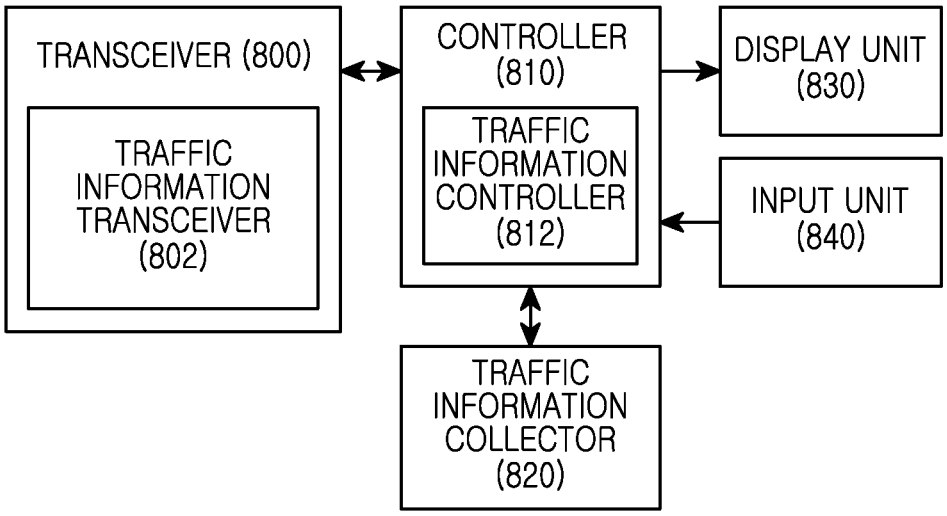
FIG. 8 is a block diagram illustrating a construction of a vehicle terminal according to an exemplary embodiment of the present invention.

FIG. 8 is a block diagram illustrating a construction of a vehicle terminal according to an exemplary embodiment of the present invention.

Referring to FIG. 8, the vehicle terminal includes a transceiver 800, a controller 810, a traffic information collector 820, a display unit 830, and an input unit 840.

In operation, the transceiver 800 transmits and receives a signal according to the control of the controller 810. Particularly, by including a traffic information transceiver 802, the transceiver 800 processes and controls a function for transmitting information, which is collected by way of the traffic information collector 820, to a server managing traffic information or a stop terminal. Here, the traffic information transceiver 800 can transmit and receive a signal using a communication technology widely known in the art. Particularly, the transceiver 800 receives a signal of informing the existence of a preliminary passenger from the server managing the traffic information or the stop terminal, and provides the received signal to the controller 810.

The controller 810 performs a control and process for a general operation of the vehicle terminal. By including a traffic information controller 812, the controller 810 controls and processes a function for controlling the traffic information collector 820 to collect traffic information real-time on a corresponding vehicle, and transmitting the collected information through the transceiver 800. Further, according to the present invention, the controller 810 controls and processes a function of identifying a corresponding stop from a signal informing the existence of a passenger, and informing a vehicle driver that the passenger exists at the identified stop.

The traffic information collector 820 includes a GPS receiver, and collects vehicle position information, in real-time, changing according to a movement of a vehicle and provides the collected position information to the controller 810.

The display unit 830 displays various state information generated during an operation of the vehicle terminal, numerals, characters, and videos. According to the control of the controller 810, the display unit 830 displays a message of informing that a passenger exists at an identified stop.

The input unit 840 includes at least one of at least one key and a touch sensor, and provides data corresponding to a key pressed by a user or data of a position touched by the user, to the controller 810.

On the basis of the aforementioned description, the following description is made for a case where a user intends to take a bus at a bus stop and a case where the user intends to take a taxi at a taxi stop.

First, in a case where a user intends to take a bus, the user can contact a user terminal with a terminal of a bus stop. If so, the user terminal transmits a signal including user information to the terminal of the bus stop using an NFC function. The terminal of the bus stop receives the signal including the user information using the NFC function, and recognizes that the user exists at the bus stop. After that, the terminal of the bus stop transmits information on a bus line going via a corresponding stop and information on an expected arrival time, to the user terminal. If so, the user terminal receives this information and receives a selection of a specific bus line from the user, and transmits information on the selected bus line to the terminal of the bus stop. The terminal of the bus stop recognizes the selected bus line received from the user terminal, and transmits a signal of informing the existence of a preliminary passenger to a terminal of the nearest bus heading for the bus stop among buses corresponding to the selected bus line. If so, the terminal of the nearest bus informs a bus driver that the preliminary passenger exists at the bus stop. By doing so, the bus driver can easily recognize the existence of the preliminary passenger and stop the bus, although the bus driver does not make observation if a preliminary passenger exists at a corresponding bus stop one by one during driving.

Next, in a case where a user intends to take a taxi, the user can contact a user terminal with a terminal of a taxi stop. If so, the user terminal transmits a signal including user information to the terminal of the taxi stop using an NFC function. The terminal of the taxi stop receives the signal including the user information using the NFC function. After that, the terminal of the taxi stop collects information of an empty taxi currently serviceable among taxes positioned in a peripheral area, and transmits the collected information of the empty taxi to the user terminal.

If so, the user terminal receives this taxi information, receives a selection of a specific taxi from a user, and transmits information on the selected taxi to the terminal of the taxi stop. The terminal of the taxi stop recognizes the selected taxi received from the user terminal, and transmits a signal of informing that a preliminary passenger exists at a corresponding taxi stop, to a terminal of the recognized taxi. If so, the terminal of the taxi informs a taxi driver that a preliminary passenger exists at a corresponding taxi stop, thereby being capable of helping the taxi driver to determine a position of the preliminary passenger and move to a corresponding taxi stop.

As described above, exemplary embodiments of the present invention have an effect of, by allowing a public transportation stop to recognize a user terminal and inform a corresponding vehicle terminal of the existence of a preliminary passenger, being capable of allowing a vehicle driver to recognize the fact that a passenger exists at a stop during running, thus preventing the vehicle driver from passing the stop without recognizing that the passenger at the next stop. The invention also enables a user to easily identify the desired vehicle without the need of checking each ride arriving at the stop. Further, the exemplary embodiments of the present invention solves an inconvenience associated with waiting for a taxi, and also enables a taxi driver to determine the exact location of next available passenger.

The above-described methods according to the present invention can be implemented in hardware, firmware or as software or computer code that can be stored in a recording medium such as a CD ROM, an RAM, a floppy disk, a hard disk, or a magneto-optical disk or downloaded over a network and stored on a non-transitory machine readable medium, so that the methods described herein can be rendered in such software using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A method for providing a public transportation service in a user terminal, the method comprising:

transmitting a signal representing user existence to a stop terminal;

receiving a signal indicating a list of available vehicle from the stop terminal;

selecting a desired vehicle according to user's control; and transmitting a signal representing information on a desired vehicle to the stop terminal.

2. The method of claim 1, wherein the signal indicating a list of available vehicle comprises at least one of a number of a bus passing a stop, a current position of the bus, an expected arrival time of the bus, at least one taxi positioned around the stop, a current position of the taxi, and availability of the at least one taxi.

3. The method of claim 1, wherein the user terminal and the stop terminal transmit and receive the signals using a Near Field Communication (NFC) function.

4. A method for providing a public transportation service in a communication system, the method comprising:

transmitting, by the user terminal, a first signal representing a user existence to a stop terminal;

transmitting, by the stop terminal, a second signal indicating a list of available vehicle to the user terminal;

selecting, by the user terminal, a desired vehicle in a list of available vehicle according to user's control;

transmitting, by a user terminal, a third signal representing information on a desired vehicle to a stop terminal; and transmitting, by the stop terminal, a fourth signal representing an existence of a passenger to the desired vehicle.

5. The method of claim 4, wherein the second signal indicating a list of available vehicle further comprises at least one of a bus passing the stop, a current position of the bus, an expected arrival time of the bus, at least one taxi positioned around the stop, a current position of the at least one taxi, and an availability of the at least one taxi.

6. The method of claim 4, wherein the second signal further comprises a location of a passenger.

7. The method of claim 4, wherein the user terminal and the stop terminal communicates using a Near Field Communication (NFC) function.

8. A method for providing a public transportation service in a stop terminal, the method comprising:

receiving a signal representing a user existence from a user terminal;

transmitting a signal indicating a list of available vehicle to a user terminal;

receiving a signal representing information on a desired vehicle from the user terminal; and transmitting a signal representing an existence of a passenger to a terminal of the desired vehicle.

9. A user terminal for providing a public transportation service, comprising:

a transceiver configured for transmitting and receiving a signal; and a controller configured for controlling to transmit a signal representing user existence to a stop terminal through the transceiver, receive a signal indicating a list of available vehicle from the stop terminal, select a desired vehicle according to user's control and transmit a signal representing information on a desired vehicle to the stop terminal.

10. The user terminal of claim 9, wherein the signal indicating a list of available vehicle comprises at least one of a number of a bus passing a stop, a current position of the bus, an expected arrival time of the bus, at least one taxi positioned around the stop, a current position of the taxi, and availability of taxi.

11. The user terminal of claim 9, wherein the transceiver transmits and receives the signals with the stop terminal using a Near Field Communication (NFC) function.

12. A system for providing a public transportation service, comprising:

a user terminal transmitting a first signal representing information on a desired vehicle;

at least one vehicle terminal; and a stop terminal receiving the first signal and transmitting a second signal representing an existence of a passenger to a terminal of desired vehicle and transmitting a second signal representing an existence of a passenger to the desired vehicle, wherein the user terminal transmits a third signal representing an user existence to the stop terminal, receives a fourth signal indicating a list of available vehicle from the stop terminal, and selects the desired vehicle in a list of available vehicle according to user's control.

13. The system of claim 12, wherein the fourth signal indicating a list of available vehicle further comprises at least one of a bus passing the stop, a current position of the bus, an expected arrival time of the bus, at least one taxi positioned around the stop, a current position of the taxi, and availability of the at least one taxi.

14. The system of claim 12, wherein the second signal further comprises a location of a passenger.

15. The system of claim 12, wherein the user terminal and the stop terminal communicates using a Near Field Communication (NFC) function.

16. A stop terminal for providing a public transportation service, comprising:

a transceiver configured for transmitting and receiving a signal; and a controller configured for controlling a function for receiving a signal representing user existence from a user terminal through the transceiver, transmitting, in response, a signal indicating a list of available vehicle for selection by the user terminal; receiving information on a desired vehicle, from the user terminal, and transmitting a signal of informing the existence of a passenger to a terminal of the desired vehicle.

* * * * *